United States Patent [19]

Forsyth, III et al.

[11] Patent Number: 4,669,952

[45] Date of Patent: Jun. 2, 1987

[54] QUIET BY-PASS VACUUM MOTOR

[75] Inventors: Thomas C. Forsyth, III, Kent; Leonard J. Kline, Jr., Ravenna; Daniel F. McCauley, Akron, all of Ohio

[73] Assignee: Ametek, Inc., Kent, Ohio

[21] Appl. No.: 735,469

[22] Filed: May 17, 1985

[51] Int. Cl.[4] ..... F04D 29/66

[52] U.S. Cl. ..... 415/119; 415/210

[58] Field of Search ..... 415/119, 210, 209, 219 R, 415/219 C, 219 A, 208, 211, 199.2; 417/423, 369

[56] References Cited

U.S. PATENT DOCUMENTS

| | | | |
|---|---|---|---|
| 2,044,830 | 6/1936 | Carlstedt | 415/199.2 |
| 2,236,265 | 3/1941 | Hansson et al. | 417/369 |
| 2,245,334 | 6/1941 | Fredlund | 415/119 |
| 2,328,038 | 8/1943 | Taylor | 417/369 |
| 2,333,339 | 11/1943 | Reeves | 415/199.2 |
| 2,775,945 | 1/1957 | Arutunoff | 415/199.2 |
| 2,888,192 | 5/1959 | Cole et al. | 415/210 |
| 2,970,234 | 1/1961 | Erickson | 415/209 |
| 3,286,984 | 11/1966 | Bachl | 415/219 A |
| 3,791,772 | 2/1974 | Keimpema et al. | 415/211 |
| 3,802,046 | 4/1974 | Wachtell | 415/211 |
| 3,846,047 | 11/1974 | Wada et al. | 415/219 C |
| 4,057,370 | 11/1977 | Numata et al. | 415/211 |
| 4,065,233 | 12/1977 | Torigoe et al. | 415/211 |

*Primary Examiner*—Robert E. Garrett
*Assistant Examiner*—John Kwon
*Attorney, Agent, or Firm*—Oldham, Oldham & Weber Co.

[57] ABSTRACT

A quiet by-pass vacuum motor wherein a ring-like cavity is defined between inner and outer walls of the housing for a working air fan. Separating members divide the cavity into passageways which communicate with openings in the housing. A plate having a plurality of vanes thereon is received upon the separating members, the plate extending from the outer wall to a position short of the inner wall. A baffle plate is then received upon the vanes. Working air is exhausted over the baffle plate, between the vanes, over the plate and between the separating members and through the openings. The exhaust path greatly reduces the noise level of the vacuum motor.

8 Claims, 11 Drawing Figures

QUIET BY-PASS VACUUM MOTOR

TECHNICAL FIELD

The invention herein resides in the art of vacuum motors and, more particularly, to a by-pass vacuum motor having a unique structure for diffusing the working air in a quiet and efficient manner.

BACKGROUND ART

Presently there are known various types of by-pass vacuum motors. Typically, such motors have several air paths, the working air path being separate from the motor cooling air path, such that affluent does not reach the motor assembly itself. Having several air paths, necessarily generated by separate fans, the generation of noise is of concern in such units. Conventional by-pass vacuum motors generate a large siren-like noise component due to the proximity of the exhaust louver ports to the high speed rotating fan blade passing thereby. The noise is generated by the attendant pressure pulses characterizing the working air. As is known, the noise frequency is dependent upon motor speed, the number of fan blades per fan, and the number and proximity of stationary objects such as louvers or exhaust ports. There is also a broad band noise component resulting from the vortex and turbulence of the air as it leaves the rotating fan.

While the prior art design of by-pass vacuum motors has been conducive to ease of manufacture of an efficiently operating system, such has been at the expense of audible noise. While noise is typically objectionable in any environment, the use of such motors in hospitals, rest homes, and the like dictates that the noise level be significantly reduced. In the past, to reduce sound, substantial amounts of sound absorbing material and/or labyrinthing have been added to the vacuum cleaner or other device requiring the by-pass type vacuum motor, all at the expense of material, labor, and physical size. Additionally, such structures have often been found to reduce motor efficiency.

DISCLOSURE OF INVENTION

In light of the foregoing, it is the first aspect of the invention to provide a by-pass vacuum motor which eliminates louvers for the exhausting of the working air.

Another aspect of the invention is the provision of a by-pass vacuum motor of compact size and reduced noise generation with respect to the prior art.

Still a further aspect of the invention is the provision of a by-pass vacuum motor which achieves an increased exhaust air path within a confined and restricted area.

Still a further aspect of the invention is to provide a by-pass vacuum motor wherein the working air is exhausted by compound diffusion.

Yet another aspect of the invention is the provision of a by-pass vacuum motor, quieter in operation than those previously devised, and implemented utilizing state of the art technology.

The foregoing and other aspects of the invention which will become apparent as the detailed description proceeds are achieved by the improvement in a vacuum motor, comprising: a housing receiving a working air fan in a first end thereof, and having a ring-like cavity defined within a second end thereof, said working air fan drawing working air into said housing through said first end and exhausting said working air through said second end thereof; and diffusing means within said cavity for receiving said working air, and axially and radially redirecting said working air as it is exhausted through said second end of said housing.

DESCRIPTION OF DRAWINGS

For a complete understanding of the objects, techniques and structure of the invention reference should be made to the following detailed description and accompanying drawings wherein:

FIG. 4 comprising

DETAILED DESCRIPTION OF PREFERRED EMBODIMENT

Figure 1:
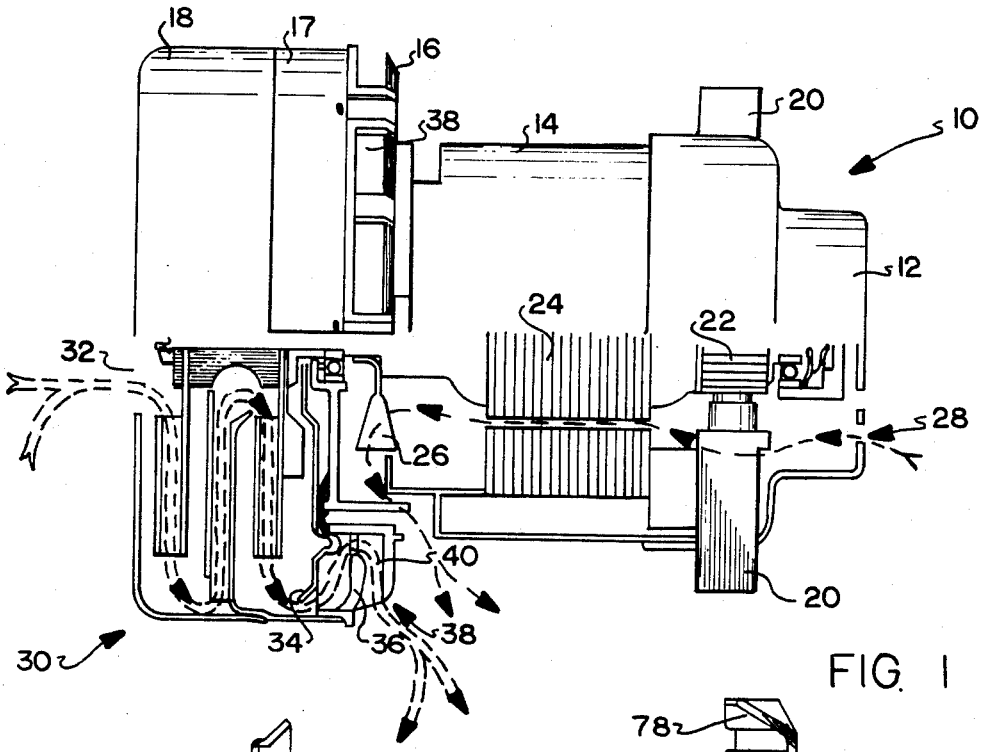
FIG. 1 is a partial sectional view of a by-pass vacuum motor made in accordance with the teachings of the invention.

Referring now to the drawings and more particularly FIG. 1, it can be seen that a by-pass vacuum motor according to the invention is designated generally by the numeral 10. In standard fashion, the vacuum motor 10 includes a commutator end bracket or cap 12, a fan end bracket 16, and a band 14 interposed therebetween. A fan shell 18 mates with the stationary fan shell 17 which encloses the end of the fan end bracket 16 to receive therein the fan assembly as will be discussed hereinafter. Suffice it to say that the elements 12-18 define a housing, with the motor elements being maintained within the confines of the bracket 12 and band 14, and the fan assembly being maintained within the bracket 16 and fan shells 17,18.

Brush assemblies 20 are provided in contacting communication with the commutator 22 within the commutator end bracket 12. An armature and field coils 24 are maintained within the band 14. In the embodiment shown, a motor cooling air fan 26 is maintained at the bottom of the band 14 in juxtaposition to the top end portion of the fan end bracket 16. The fan 26 draws air through openings 28 in the top of the commutator end bracket 12, around the commutator, through the armature and coils, and exhausts the same through openings between the band 14 and fan end brackets 16. It has been found that by positioning the motor cooling fan 26 at the bottom of the motor assembly and adjacent the fan assembly, motor cooling is more efficient and the fan 26 is quieter, due in part to the fact that it is maintained centrally within the system as a whole.

The fan shells 17,18 encase a fan assembly 30 which, when rotated by the motor, is operative to draw working air through the annular opening 32 centrally positioned within the bottom of the shell 18. The working air, drawn by the vacuum fan assembly 30, passes through the various fan elements thereof as shown and thence over the baffle plate 34 as shown. It will be observed that the baffle plate 34 has a circumferential edge which is angled in such a manner as to direct the working air inwardly as shown. The air reaches a diffuser system 36 which is maintained within the fan end bracket 16 as will be discussed later herein. The working air is then exhausted out through the openings 38 positioned circumferentially about a top edge portion of the fan end bracket 16. As shown, the fan end bracket 16 defines a ring-like cavity 40 in which the diffuser system 36 is received as will be discussed later. It should be appreciated that it is the structure for diffusing the working air which comprises the heart of the invention herein and which will be elaborated upon below.

Figure 2:
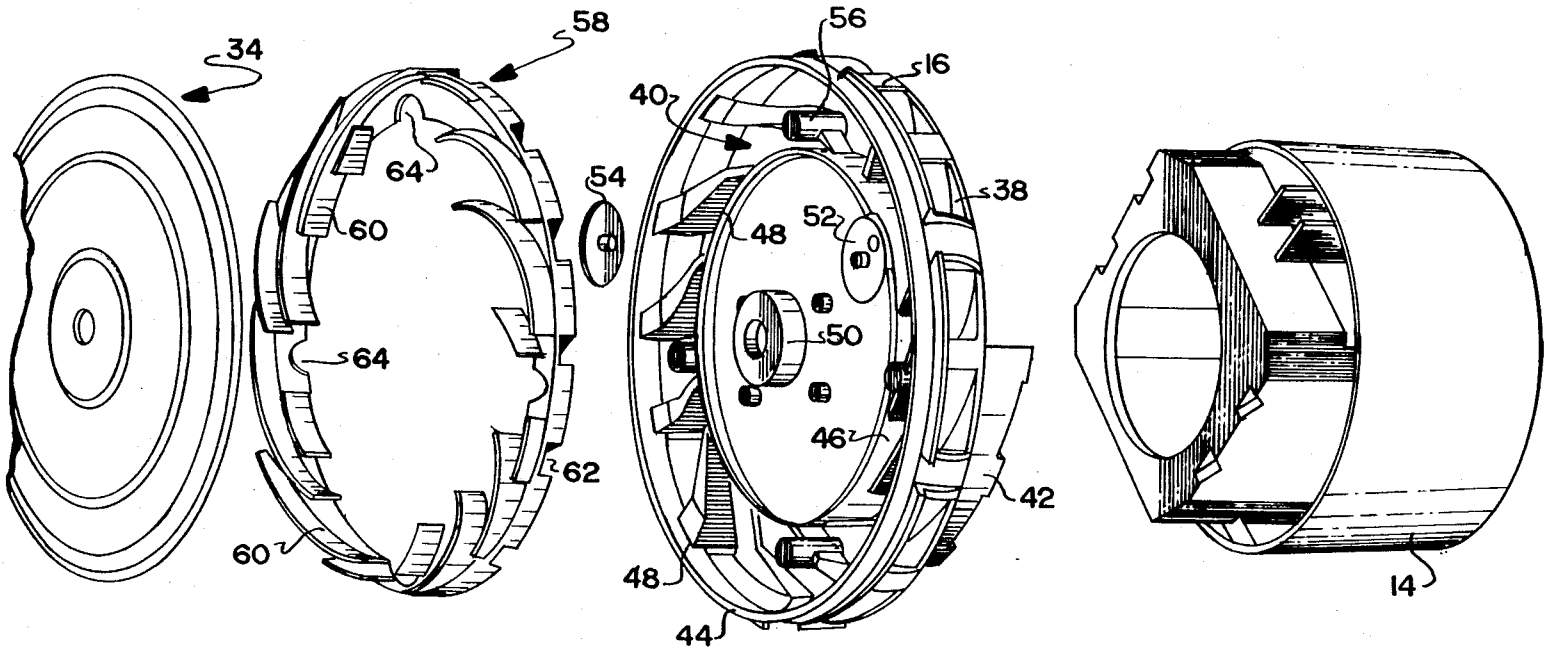
FIG. 2 is an assembly drawing of the working air diffusion exhaust system of the invention.

With reference now to FIG. 2, it can be seen that the fan end bracket 16 is characterized by ears 42 extending therefrom for receipt by the band 14 alongside the armature and field 24 of FIG. 1. The fan end bracket 16 includes an outer wall 44 and an inner wall 46, the two walls defining therebetween the ring-like cavity 40. Separating wedges or members 48 extend from the outer wall 44 to the inner wall 46 and define passageways therebetween to the exhaust openings 38. It will be noted that the separating wedges 48 do not extend the entire height of the walls 44,46 and, when considering the flow of the exhausting air, actually extend outwardly from the inner wall 46 to the outer wall 44. A motor shaft bearing hub 50 is centrally positioned within the fan end brackets 16, having an aperture therein through which passes the motor and fan shaft. A check valve recess 52 and a check valve 54 are provided in previously-known fashion.

Mounting screw posts 56 are provided as shown, again in standard fashion and not particularly comprising a portion of the invention herein.

A diffuser insert 58 is adapted to be received within the cavity 40, between the walls 44,46, and over the separating wedges or members 48. The diffuser insert 58 is characterized by a plurality of vanes 60 which radially turn inward. Grooves 62 in the bottom of the diffuser insert 58 are provided of substantially the same contour as the separating wedges 48 and are accordingly received thereby when the insert 58 is placed within the cavity 40. It will also be noted that semicircular notches 64 are provided about the inner periphery of the insert 58 to accommodate the posts 56. As will be discussed directly below, the baffle plate 34 is pressfit onto the inner wall 46 of the fan end bracket 16 to secure the diffuser insert 58 within the cavity 40.

Figure 3:
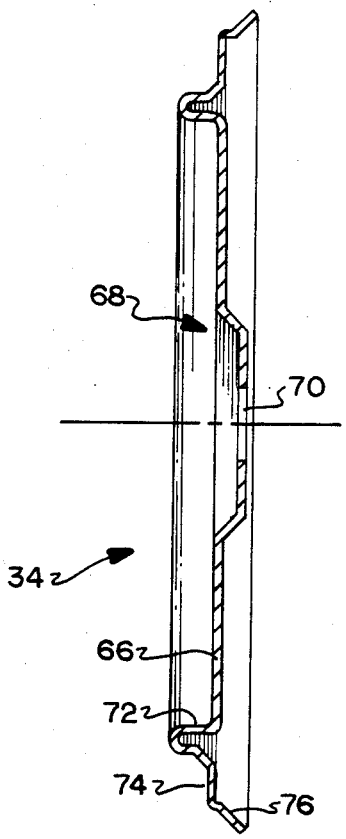
FIG. 3 is a cross sectional view of the baffle plate of the invention.
Figure 4B:
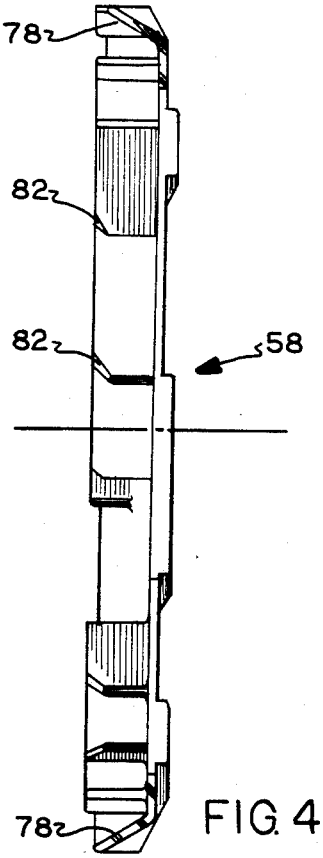
FIGS. 4A–4F, are top plan, side elevational, bottom plan, and sectional views of the diffuser insert of the invention.

With reference now to FIG. 3, a central cross sectional view of the baffle plate 34 may be seen. As shown, a flat disc portion 66 extends to a centrally extended portion 68 having a hole 70 passing therethrough. The hole 70 is adapted for receiving the motor or fan shaft. A downwardly turned edge 72, normal to the plane of the disc portion 66, defines a ring-like flange of substantially the same diameter as the inner wall 46.

This flange accommodates the press fitting of the baffle plate 34 onto the inner wall 46 as discussed above. With the ring-like flange 72 engaging the wall 46, the circumferential horizontal flange 74 engages the diffuser insert 58 to hold the insert 58 in place within the cavity 40. The upwardly flared edge 76 is adapted to direct the working air from the fan chamber into the cavity 40 as discussed above.

The detailed structure of the diffuser insert 58 may be seen in FIG. 4. As shown in the drawing, the outer circumferential edge portion 78 of the insert 58 slopes downwardly toward the center of the insert 58 to provide direction to the exhausting air as it comes over the flared edge 76 of the baffle plate 34. The inwardly sloping surface 78 mates with a flat base portion 80. The vanes 60 are evenly spaced circumferentially about the insert 58. As can be seen from the drawing, they are helical, of constantly decreasing radiuses as they move inwardly toward the center of the insert 58. This design allows the air being brought over the baffle plate 34 to be directed between the vanes radially inward to the inner wall 46 of the fan end bracket 16 more rapidly than if the curvature of the vanes 60 were circular rather than helical. As shown, each of the vanes 60 has a chamferred edge 82 to better receive the baffle plate 34 when it is seated thereagainst and pressfit upon the inner wall 46. It will be noted that the width of the base 80 is less than the width of the cavity 40 such that the ends of the vanes 60 contact the wall 46 and allow an opening between the flat base portion 80 and the wall 46 for the exhausting air to roll over the edge of the flat portion 80 and deeper into the cavity 40 between the wedges 48.

Figure 5:
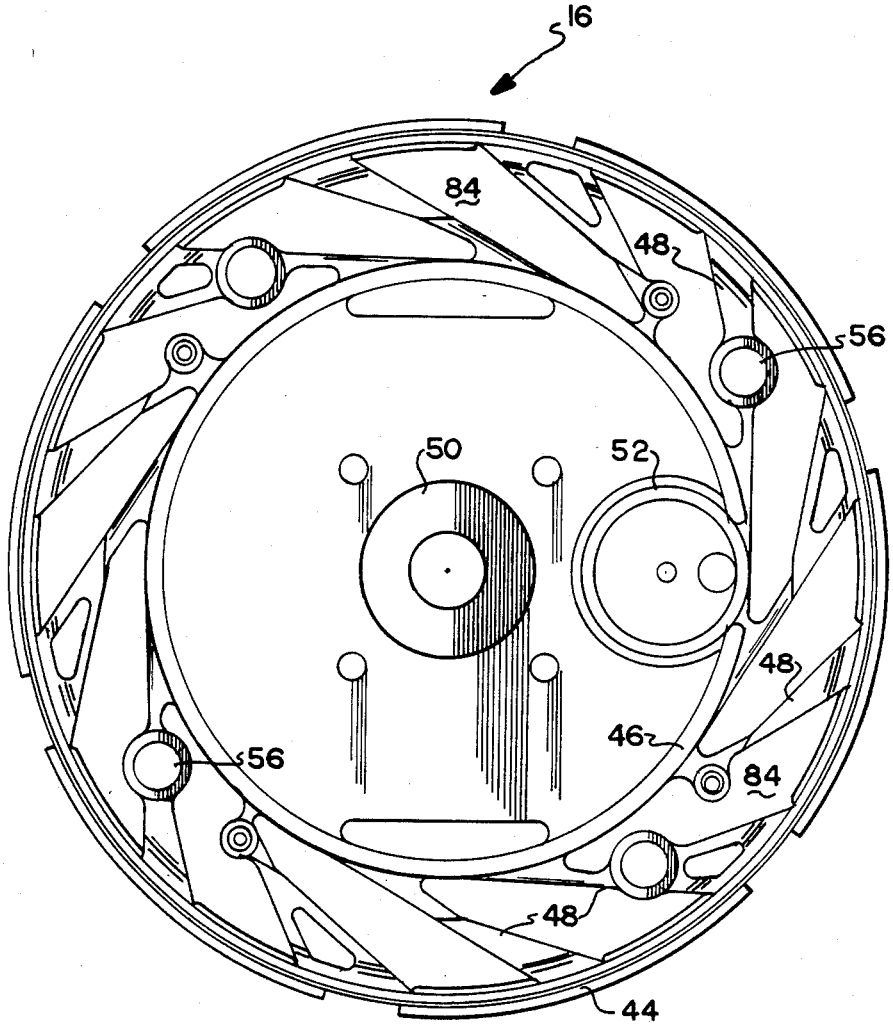
FIG. 5 is a top plan view of the fan end bracket of the by-pass motor of the invention.

As the exhausting air rolls over the flat base portion 80, along the inner wall 46, and deeper into the cavity 40, it is received by the passages 84 defined between the separating wedges 48 of the fan end bracket 16 as shown in FIG. 5. The passages 84 communicate with the openings 38 about the periphery of the fan end bracket 16 as best shown in FIG. 2. As observed in FIG. 5, the passages 84 extend somewhat tangentially from the inner wall 46 to the openings 38 and are of increasing cross sectional area from the wall 46 to the wall 44. This increase in area assists in the air movement, by reducing pressure.

It should now be appreciated that as the exhausting air passes through the passages between the vanes 60 and rolls over the edge of the insert 58, the air then changes direction from an inward movement to an outward movement, but in the same general circumferential direction. In other words, while the air is moving within the insert 58 inwardly toward the wall 46, and within the cavity 40 outwardly from the wall 46, the flow of such air is still generally circumferential with respect to the composite of the insert 58 and the fan end bracket 16 taken as a whole.

Figure 6:
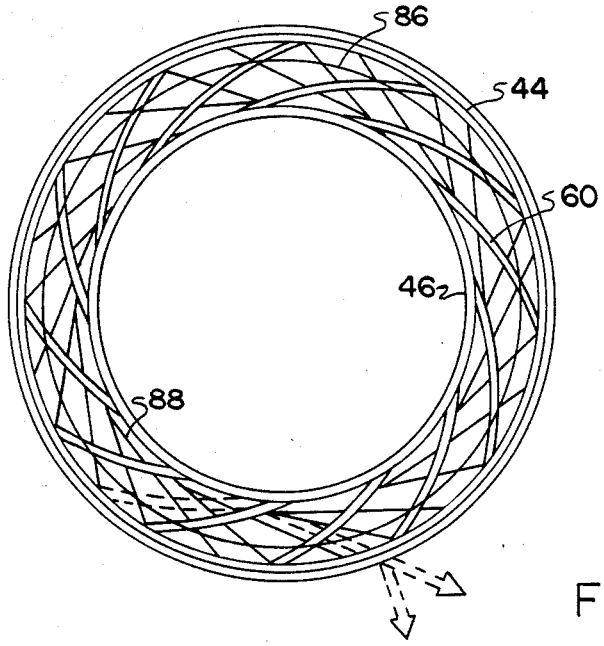
FIG. 6 is an illustrative view of the exhaust air path for the working air as viewed from the fan side of the vacuum motor unit of the invention showing the diffuser insert received within the fan end bracket.
Figure 4A:
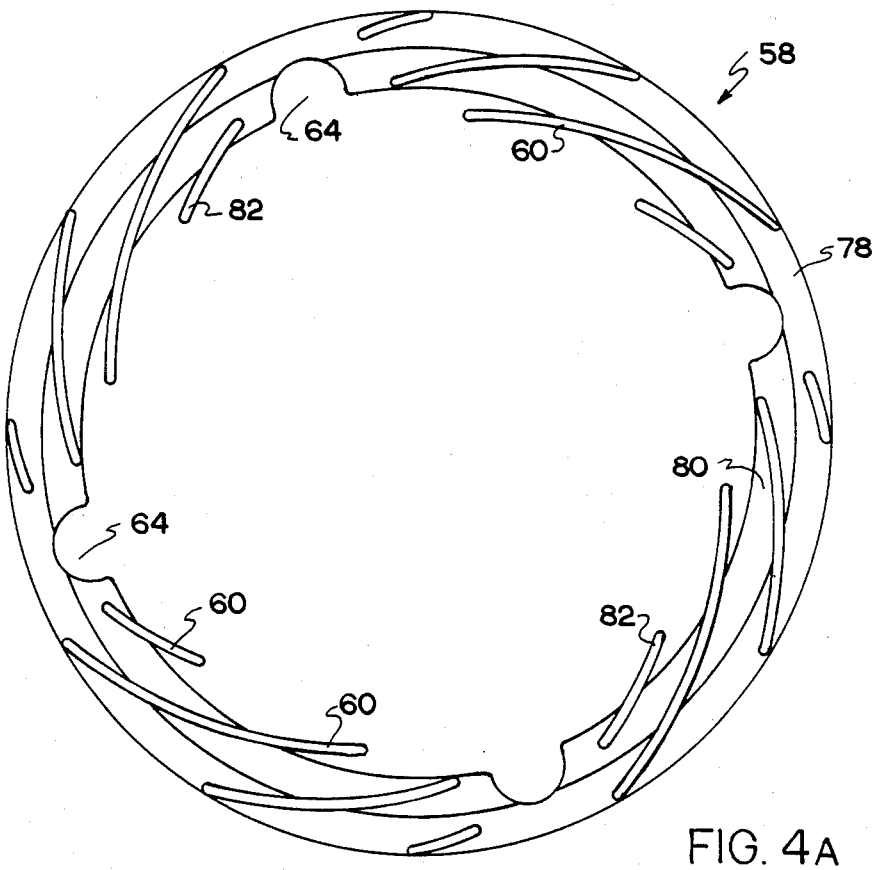
Figure 4D:
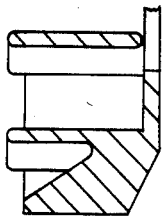
Figure 4E:
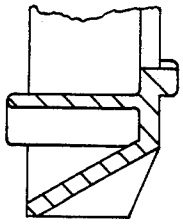
Figure 4F:
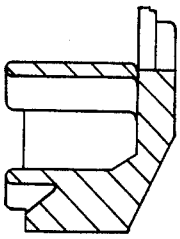
Figure 4C:
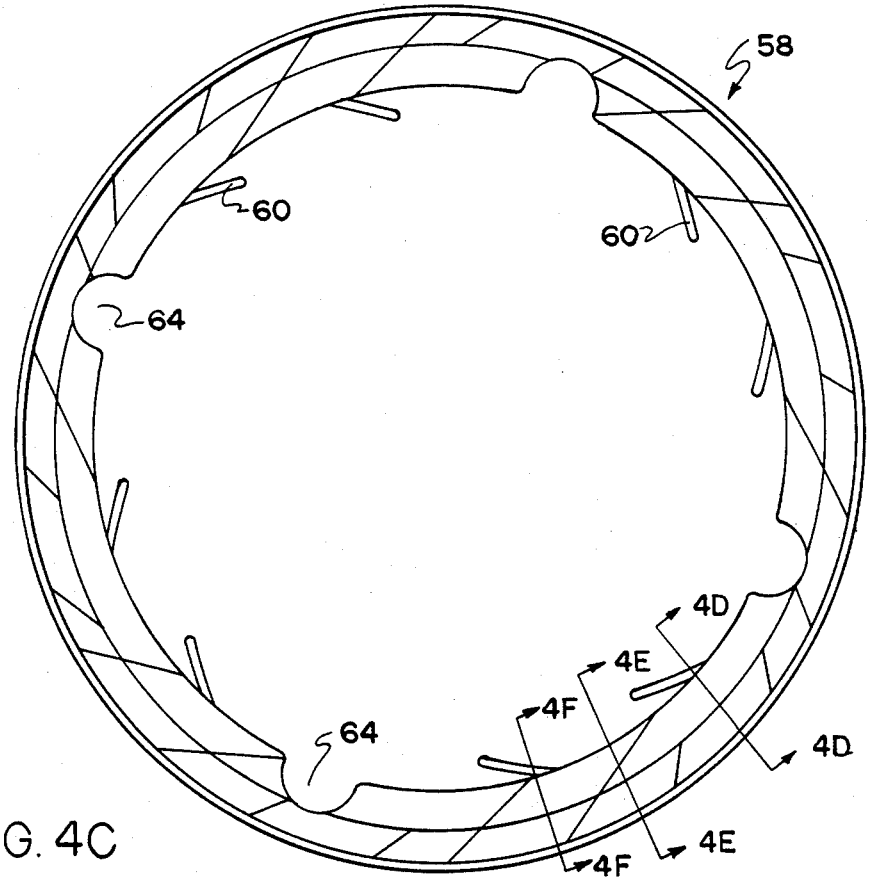

The actual path of the air movement is illustratively shown in FIG. 6. It will be noted that the air movement in FIG. 6 is generally into the paper and counterclockwise. The air rolls over the flared edge 76 of the baffle plate 34 and is directed thereby onto the sloping surface 78 of the insert 58. Obviously, at this point in time the air is being moved between pairs of vanes 60, sealed at the top by the baffle plate 34. The air passes over the sloped surface 78, and onto the flat base portion 80, the surfaces 78,80 forming the junction designated by the numeral 86. The air then moves across the flat base portion 80 to the edge 88 thereof, where it is forced downwardly into the passageway 84 between the separating wedges 48 and exhausted outwardly through the openings 38. The actual air path is shown by the dashed line in FIG. 6. It will be appreciated by those versed in mathematical expression that the "down and out" air passage just defined with respect to FIG. 6 is similar to a curtate-cycloidic curve.

Exhausting of the working air by the structure presented above is achieved without pressure pulses incident to the movement of a fan across abrupt surfaces or edges. The air moves generally in a constant circumferential direction, while changing radial direction at the edge of the insert 58. The exhausting of the air is achieved at the edge of the fan end bracket while the diffusion of the same by the insert 58 and the separating wedges 48 of the fan end bracket 16 is achieved within the previously unused cavity 40. According ly, the fan motor assembly may maintain a compact nature.

The efficiency of the motor is maintained by virtue of the increasing air passage area from the time the air enters between the vanes 60 until it exits through the openings 38.

Thus it can be seen that the objects of the invention have been achieved by the structure presented hereinabove. While in accordance with the patent statutes only the best mode and preferred embodiment of the invention has been presented and described in detail, it is to be understood that the invention is not limited thereto or thereby. Accordingly, for a true appreciation of the scope and breadth of the invention reference should be had to the following claims.

What is claimed is:

1. In a vacuum motor, the improvement comprising:

a housing receiving a working air fan in a first end thereof, and having a ring-like cavity defined within a second end thereof, said working air fan drawing working air into said housing through said first end and exhausting said working air through said second end thereof;

diffusing means within said cavity for receiving said working air, and axially and radially redirecting said working air as it is exhaussted through said second end of said housing;

wherein said cavity is defined by an inner and outer wall, said outer wall having openings therein for exhausting said working air, and wherein separating members extend between said inner and outer walls, defining passages from said inner wall to said openings said passage being of increased width from said inner wall to said outer wall; and wherein said diffusing means comprises a first place received on said separating members and having a plurality of vane extending therefrom, said vanes extending helically inwardly from said outer wall to said inner wall, and having a decreasing radius of curvature from said outer wall to said inner wall

2. The improvement in a vacuum motor according to claim 1 which further includes baffle means for separating said first end from said second end of said housing.

3. The improvement in a vacuum motor according to claim 2 where said baffle means comprises a second plate having an outer circumferential edge maintained in spaced relationship from said housing and angled inwardly- from said first end of said housing toward said second end.

4. The improvement in a vacuum motor according to claim 3 wherein said cavity is defined between an inner wall and an outer wall and said second plate includes a ring-like flange extending therefrom, said inner wall and said flange having substantially the same diameter, said flange being received by said inner wall.

5. The improvement in a vacuum motor according to claim 1 wherein said separating members are of a height less than the height of said inner wall.

6. The improvement in a vacuum motor according to claim 5 wherein said vanes extend radially inward from said outer wall to said inner wall, and said separating members extend radially outward from said inner wall to said outer wall.

7. The improvement in a vacuum motor according to claim 6 wherein said first plate is narrower than the width of said cavity as defined between said inner and outer walls.

8. The improvement in a vacuum motor according to, claim 7 wherein said baffle means comprises a second plate received upon a top edge portion of said vanes and defining paths between said vanes.

* * * * *